US006375165B1

(12) United States Patent
Sherratt et al.

(10) Patent No.: US 6,375,165 B1
(45) Date of Patent: Apr. 23, 2002

(54) MOVABLE BARRIER FOR INFANTS

(76) Inventors: Richard Sherratt, 23 Seabridge, Alameda, CA (US) 94502; Michael Wenzel, 1399 Pacific Ave., #110, San Leandro, CA (US) 94577-2554; Robert Zajdel, 5298 Fairweather Ct., Castro Valley, CA (US) 94552

( * ) Notice: Subject to any disclaimer, the term of this patent is extended or adjusted under 35 U.S.C. 154(b) by 0 days.

(21) Appl. No.: 09/596,809

(22) Filed: Jun. 19, 2000

(51) Int. Cl.[7] ..... E04H 17/16
(52) U.S. Cl. ..... 256/24; 256/1
(58) Field of Search ..... 256/1, 24

(56) References Cited

U.S. PATENT DOCUMENTS

| | | | | | |
|---|---|---|---|---|---|
| 1,053,658 | A | * | 2/1913 | Sinclair | 160/300 |
| 1,099,360 | A | * | 6/1914 | Harris | 160/300 |
| 1,843,053 | A | | 1/1932 | Voll et al. | 160/328 |
| 2,859,944 | A | | 11/1958 | Cisney | 256/37 |
| 3,050,742 | A | | 8/1962 | Munson | 4/154 |
| 3,115,182 | A | | 12/1963 | Bobbitt | 160/25 |
| 3,917,231 | A | * | 11/1975 | Fink | 256/64 |
| 4,119,301 | A | * | 10/1978 | Payne | 256/41 |
| 4,124,196 | A | * | 11/1978 | Hipskind | 256/1 |
| 4,212,341 | A | | 7/1980 | Fisher | 160/84 R |
| 4,844,420 | A | | 7/1989 | Oster | 256/1 |
| 4,884,614 | A | | 12/1989 | Spurling | 160/225 |
| 5,029,819 | A | * | 7/1991 | Kane | 256/24 |
| 5,050,846 | A | * | 9/1991 | Goodman et al. | 256/1 |
| 5,081,723 | A | * | 1/1992 | Saunders | 5/100 |
| 5,660,144 | A | * | 8/1997 | Venti | 119/416 |
| 5,690,317 | A | | 11/1997 | Sandsborg | 256/1 |
| 5,704,592 | A | * | 1/1998 | White et al. | 256/25 |
| 5,718,414 | A | * | 2/1998 | Deloach et al. | 256/24 |
| 5,758,868 | A | * | 6/1998 | Shea | 256/12.5 |
| 6,142,701 | A | * | 11/2000 | Falcon | 404/6 |

* cited by examiner

*Primary Examiner*—Lynne H. Browne
*Assistant Examiner*—John B. Walsh
(74) *Attorney, Agent, or Firm*—Thomas M Freiburger

(57) ABSTRACT

A moveable gate for infants or dogs is used in doorways, hallways, stair landings and other household positions to provide a safe barrier for the child or dog. The gate, formed of a flexible material which pulls out of a housing in the manner of a window shade, has a jamb mounting at the housing end and a latch at the extended end of the curtain-like barrier. Both are releasable from a fixture which attaches to the door jamb, wall or stair rail post, so that the infant gate can be quickly released and moved to another location in the house where additional such jamb mountings are attached or to another house which has similar door jamb pieces installed. Important features are the manner in which the gate latches, a mechanism for tightening the curtain-like barrier into a nearly solid gate after it has been latched, and childproof devices for releasing tension in the gate when it is to be retracted.

9 Claims, 7 Drawing Sheets

54
64
38

MOVABLE BARRIER FOR INFANTS

BACKGROUND OF THE INVENTION

The invention relates to a barrier which is easily opened and closed to close off access across a doorway, hallway or other throughway in a house or other domicile. More specifically, the invention is concerned with a portable barrier for a child or dog, in the form of a roll-up sheet or curtain on a vertical axis, of sufficient height to prevent a child or dog from crossing the barrier.

Infant barriers, or baby gates, have been known in several forms. The most common conventional configuration was a device assembled of a series of wooden slats pivotally connected in scissors fashion, so that the slats would stack together relatively compactly with the device retracted against a wall, but would extend across and close the opening when the outer end was pulled, causing all the slats to pivot to oblique, parallelogram-forming orientations. Problems with such baby gates included latches that were not totally secure, bulkiness when the barrier was retracted, and a tempting open web of rigid members which could be climbed by some young children.

U.S. Pat. No. 5,690,317, Sandsborg, shows a form of child barrier or baby gate of the general type with which this invention is concerned. That barrier included a curtain of material which extended from and retracted to a housing adjacent to one jamb of the device on a vertical roll-up axis. The barrier device had a mechanism which locked the curtain against further extension once the barrier was pulled beyond the other jamb and then was allowed to retract somewhat. This was a type of ratchet device that had to be manually released before the barrier could be retracted. The release device was not reliably childproof, and the barrier device did not seem to have adequate means for applying tension to the curtain-like barrier, in order to present a relatively solid wall to the child.

SUMMARY OF THE INVENTION

The invention described here provides an efficient, portable and reliable moveable gate for infants or dogs, for use in doorways, hallways, stair landings and other household positions and throughways to establish a safe barrier. The gate, formed of a flexible material which pulls out from a vertical-axis housing or frame in the spring-loaded manner of a window shade, has a jamb mounting at the housing end and a latch at the extended end of the curtain-like barrier. Both are releasable from a respective fixture which attaches to the door jamb, wall or stair rail post, so that the infant gate can be quickly released and moved to another location in the house where additional such jamb mountings are attached.

Important features of the barrier device are the manner in which the gate latches, a convenient handle for latching, a mechanism for tightening the curtain-like barrier into a nearly solid gate after it has been latched, and a childproof device for releasing tension in the gate when it is to be retracted.

DESCRIPTION OF PREFERRED EMBODIMENTS

Figure 1:
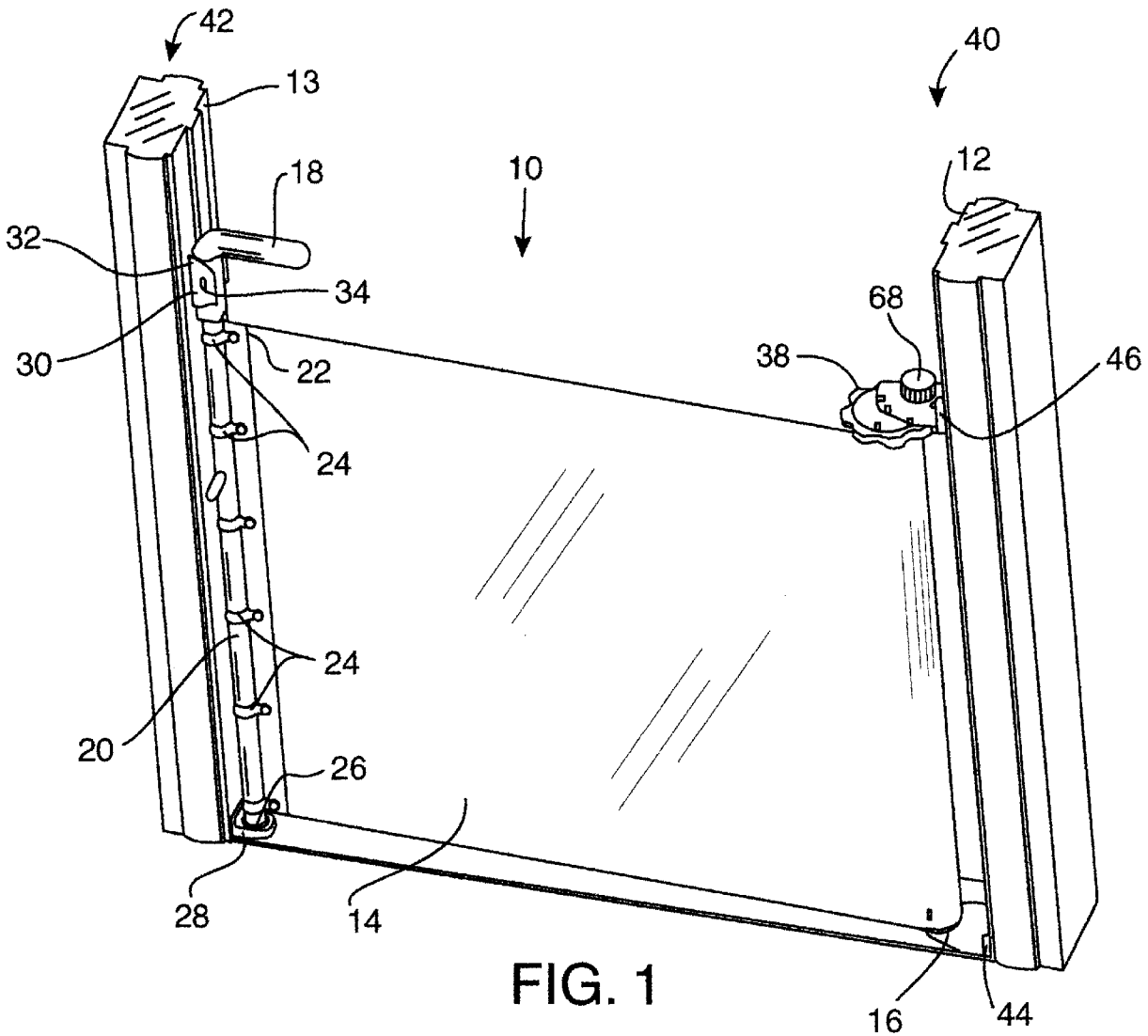
FIG. 1 is a perspective view showing a portable, retractable barrier device of the invention as installed in a doorway of a living space and with the barrier extended.

In the drawings, FIG. 1 shows a barrier device 10 as secured between two walls or door jambs 12 and 13 which form a throughway between. The barrier device 10 has a sheet of flexible barrier material 14 which is extended from a roller 16 at one side of the device, the side shown on the right in FIG. 1. The flexible barrier sheet 14 may be of woven nylon fabric, woven vinyl, vinyl-coated fiberglass, other vinyl-coated woven fibers or other similar materials providing a strong barrier sheet flexible enough to roll up. The sheet thus extends from and retracts onto the roll 16 in the manner of a roll-up window shade, with a spring inside for urging the barrier sheet toward the retracted position.

The device 10 includes, at the opposite jamb 13, a handle 18 which has a vertical rod 20 that is secured to the free end 22 of the barrier sheet, as by a series of brackets or ties 24. This handle with its vertical rod 20 is used to latch the barrier in the extended position shown. Preferably this is done by inserting the bottom end 26 of the rod, when the barrier sheet is being extended, down into a lower bracket 28 secured to the wall or jamb 13. The bottom end of the rod 20 goes into a recess of the bottom bracket 28, as shown. When the rod has been so seated, the top of the handle 18 is pushed into an upper bracket 30, between generally parallel flanges 32 as shown, until a pair of spring pins 34 spring outwardly and latch into a pair of opposed openings 36 in the bracket flanges (see FIG. 2). The barrier sheet 14 is then retained in a firmly latched position across the throughway, by the latch means which in this pictured embodiment includes the rod 20, the lower bracket 28 and the upper bracket 30. Once this has been done, a carrier tensioning means can be utilized. A tensioning handle 38 on the roller side of the device, adjacent to the jamb or wall 12, can be rotated in the tightening position (anticlockwise as seen in FIG. 1) to add more tension in the barrier sheet 14, via a ratchet mechanism to be described below.

Figure 2:
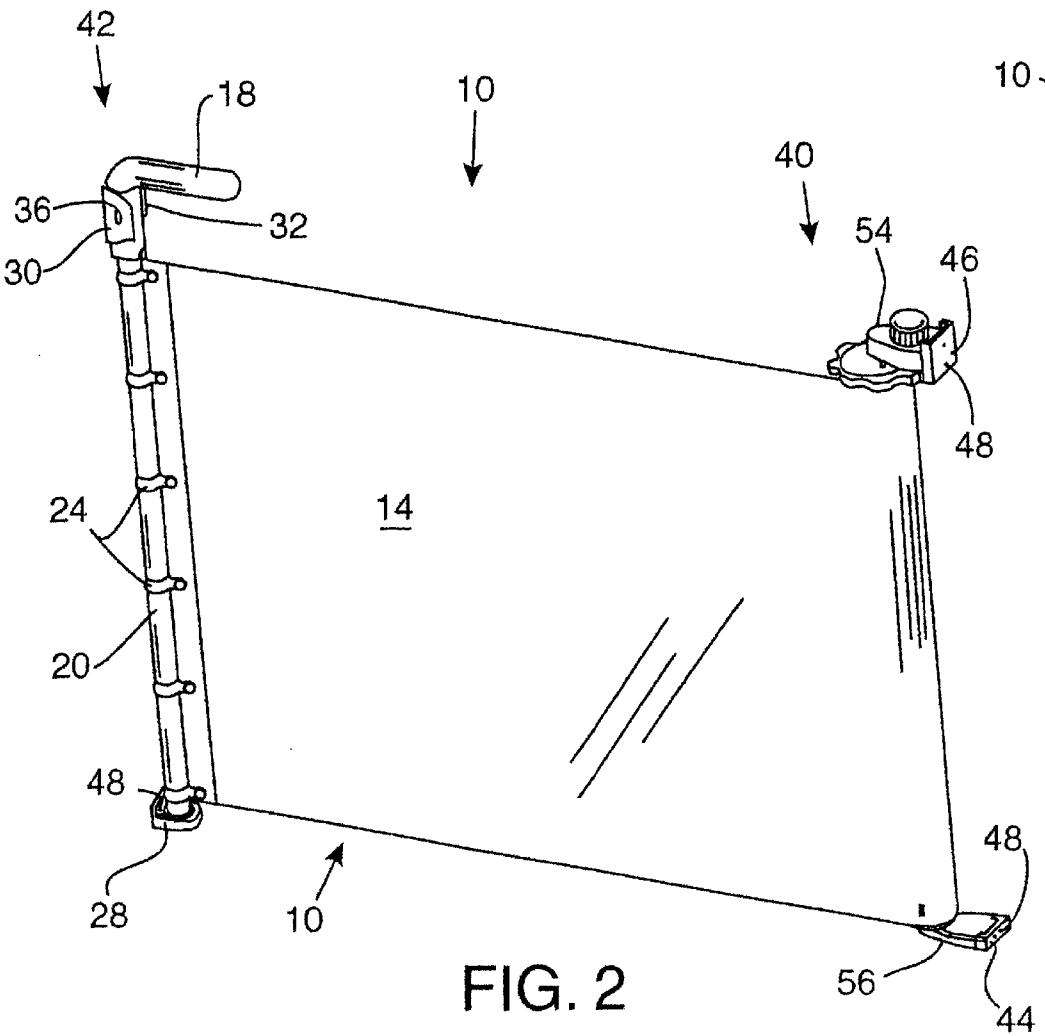
FIG. 2 is a perspective view showing the device in the extended position but without showing the doorway or walls between which the device is secured.

FIG. 2 is similar to FIG. 1, showing the barrier device 10 in the extended position, but showing the device without any door jambs or walls. Thus, FIG. 2 reveals more clearly the base side 40 of the mechanism, as well as the free side or opposite jamb side 42.

Figure 11:
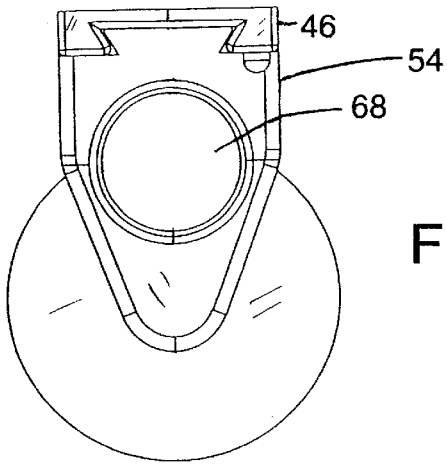
FIG. 11 is a plan view showing a portion of the apparatus at a retracted side.

As FIG. 2 illustrates, the barrier system 10 preferably includes four wall brackets or jamb brackets: the bottom bracket 28 at the barrier extension end 42, the upper bracket 30 at the extension end, and a lower bracket 44 and upper bracket 46 at the base or roller end 40 of the device. Each of these four brackets preferably has screw holes, some of which are visible at 48 in FIG. 2, for attaching the bracket to a wall, door jamb or other limit position of a throughway to be controlled. The roller-end brackets 44 and 46 advantageously are of the type which has a generally keystone-shaped recess, tapered to a narrower dimension from top to bottom, as can be seen for the bracket 46 in FIG. 11. This type of drop-in, slide-in connection is conveniently used and provides a rigid and secure retention for the device on the wall. Thus, the brackets 44 and 46 act as a first jamb connector means for connection to a door jamb or wall at one side of a throughway. If desired, a connecting structure (not shown) can be secured to or integral between the two roller-end brackets 44 and 46, so as to provide a single unified implement to be secured to the wall or jamb, even if the connecting structure is not particularly rigid. This will define precisely the spacing between the two wall brackets 44 and 46, thus preventing faulty installation and poor function in connection of the device to the wall or jamb.

At the other side 42, the extended side of the system, the brackets 28 and 30 are again screwed to the wall or jamb and provide simple and easy to use securement for the handle 18 and rod 20 at the stretched or extended end of the barrier screen 14. Again, these two brackets 28 and 30 can be connected to or integral with a vertical connecting structure between them, for purposes of assuring proper spacing on installation. The brackets 28 and 30 act as a second jamb connector means for this opposite side of the throughway.

Figure 3:
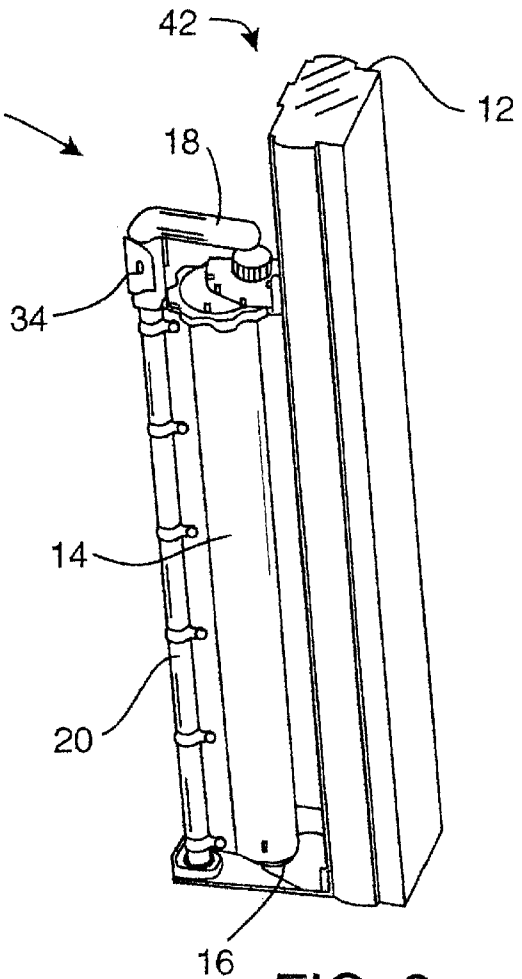
FIG. 3 is a view showing the barrier device retracted.
Figure 4:
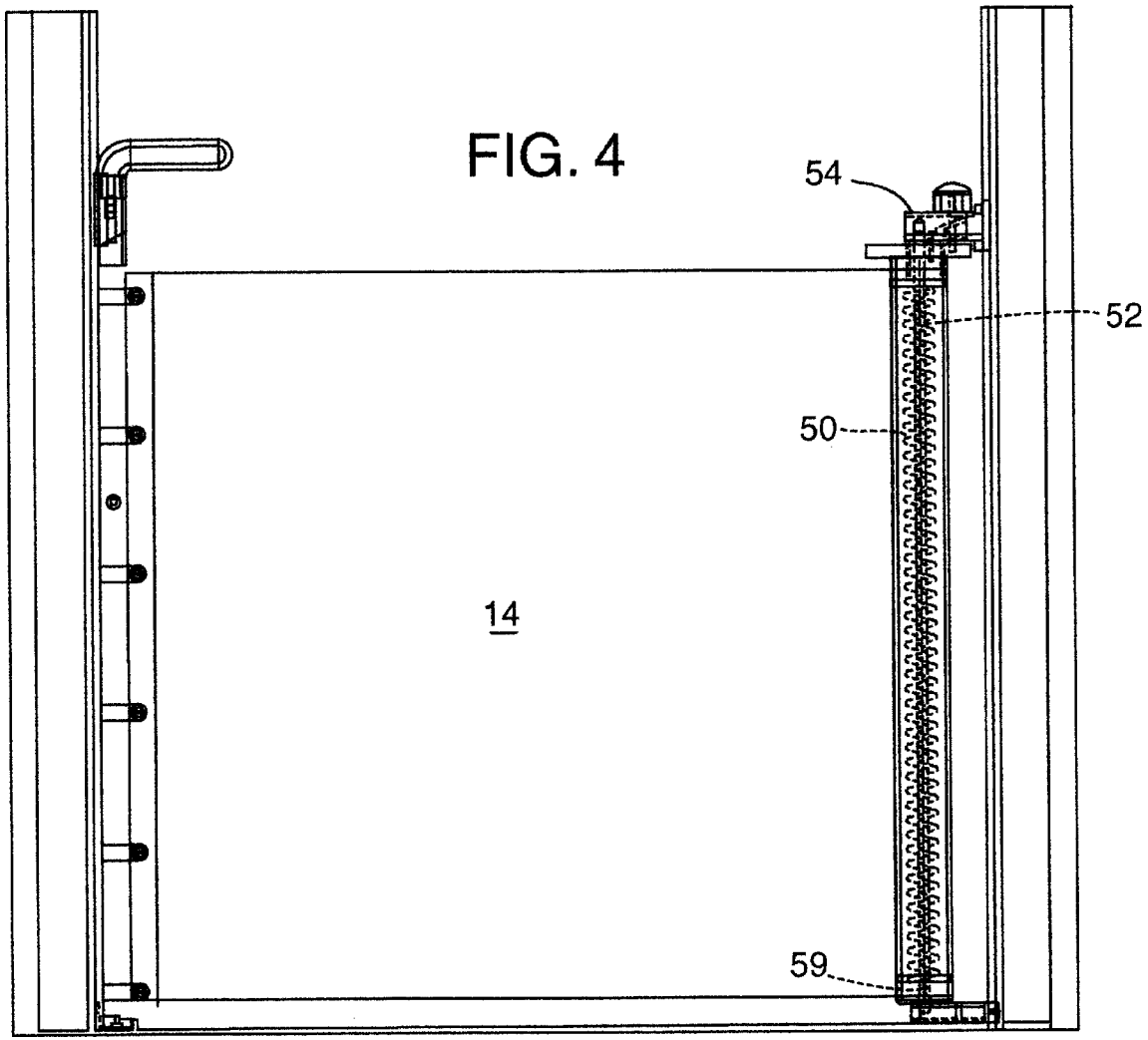
FIG. 4 is a frontal elevation view, partially broken away, showing the barrier device in the extended position in a doorway.
Figure 5:
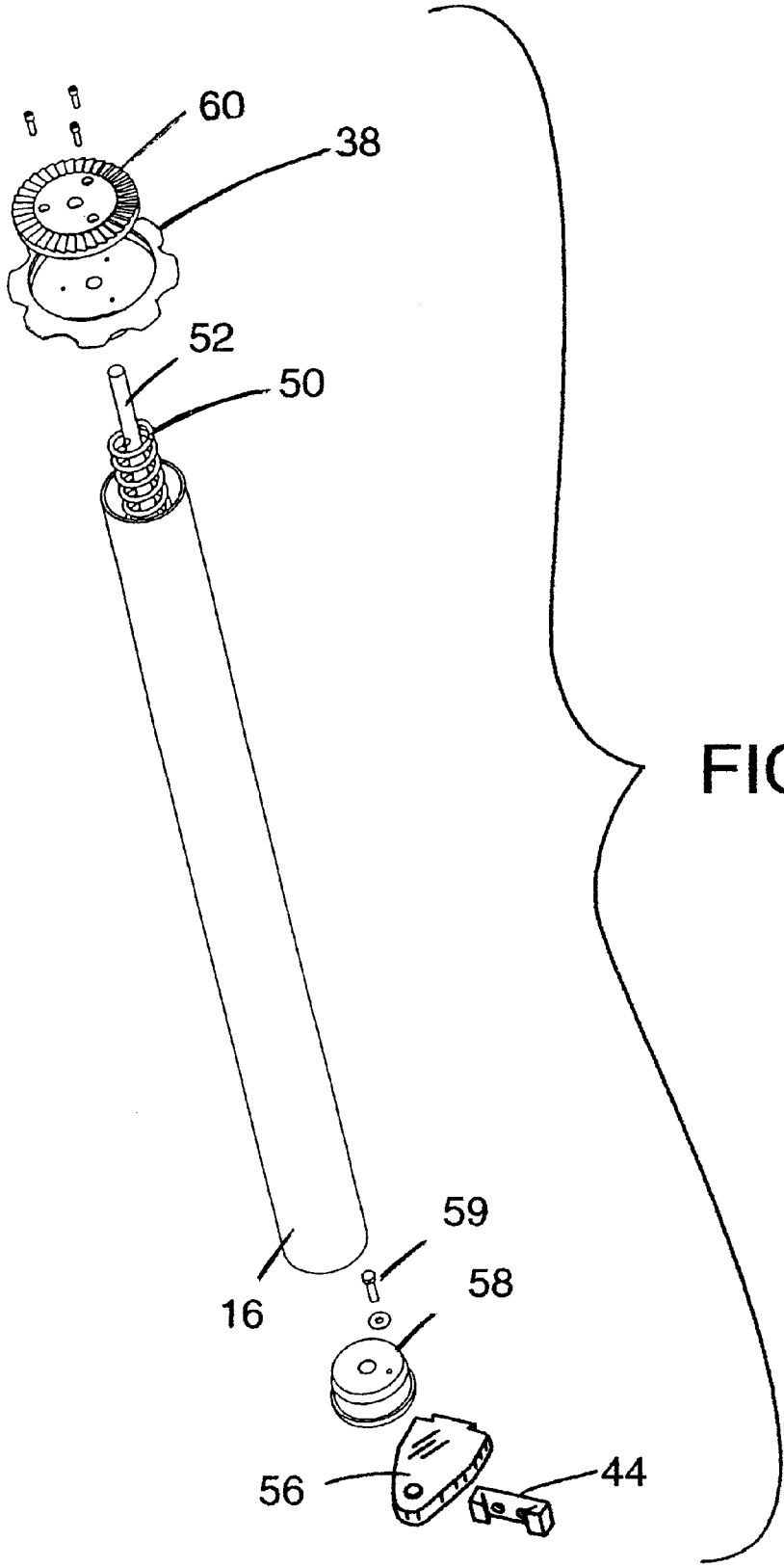
FIG. 5 is an exploded view in perspective showing a spring-loaded roller for retraction and storage of a flexible barrier sheet of the device.

FIG. 3 shows the barrier apparatus 10 in the fully retracted position, with the barrier sheet 14 rolled up on the roller or drum 16, under the influence of an internal spring 50 which is shown in FIG. 5 and also in dashed lines in FIG. 4. As shown in the drawings, the spring 50 is positioned around a central rod 52 within the roller, the rod extending beyond the top and bottom of the roller to be journalled in a clutch housing 54 at the upper end and a lower end mounting 56 at the lower end, best seen in the views of FIGS. 2, 4 and 5. The housing 54 and lower mounting 56 serve as a frame means retaining the roller for rotation at top and bottom, and these slip into the wall brackets 46 and 44 as described above, providing a quick release connection means. Since the roller or drum 16 rotates relative to the mounting apparatus at the jamb, to allow extension and retraction of the sheet of barrier material 14, the rod 52 preferably is fixed in position in the lower end mounting 56 and/or in the clutch housing 54, against rotation. The spring 50 is fixed to the rod 52 at one end, and to a hub 58 at the other end, so as to wind up and store energy acting between the stationary rod 52 and the rotatable drum or roller 16. A machine bolt 59 may be employed to retain the spring to the hub 58, via an eyelet (not shown) formed in the lower end of the spring. The lower hub 58 is fixed to the roller 16, and thus to the tensioning wheel or handle 38, which acts as an upper-end hub, at the upper end. As best seen in FIG. 5, a ratchet wheel 60 is fixed to the tensioning wheel 38, for interaction with a ratchet pawl 62 shown in FIG. 6 and also in FIG. 9. In the assembled device, the ratchet wheel 60 is covered by a cover plate 64, with the pawl passing through a slot 66 in the plate, as detailed in the exploded view of FIG. 6. FIG. 7 shows this portion of the device in the assembled configuration.

Figure 6:
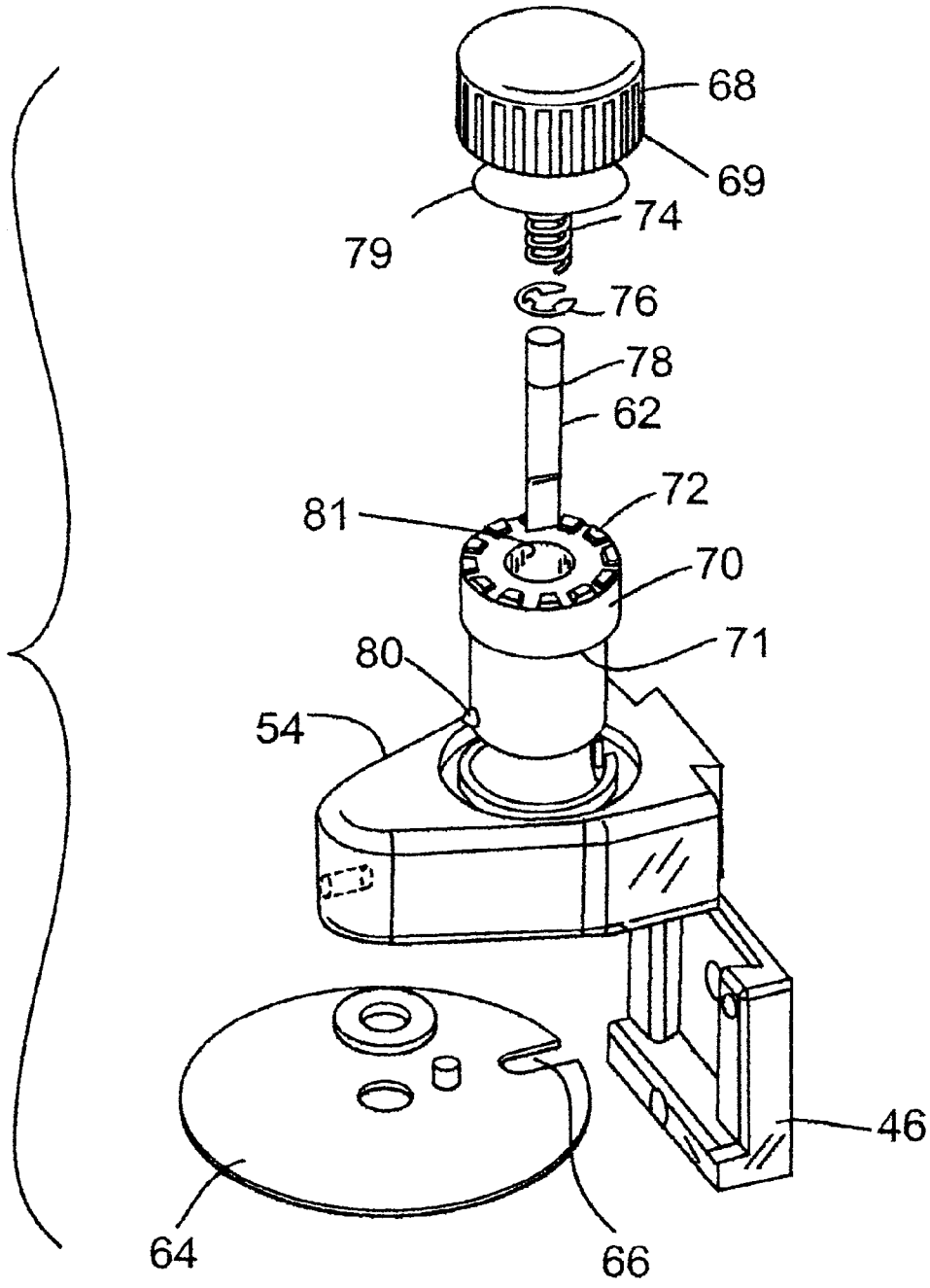
FIG. 6 is an exploded view in perspective showing components of a clutch, clutch housing, a portion of a ratchet assembly, and upper mounting assembly for the barrier.
Figure 7:
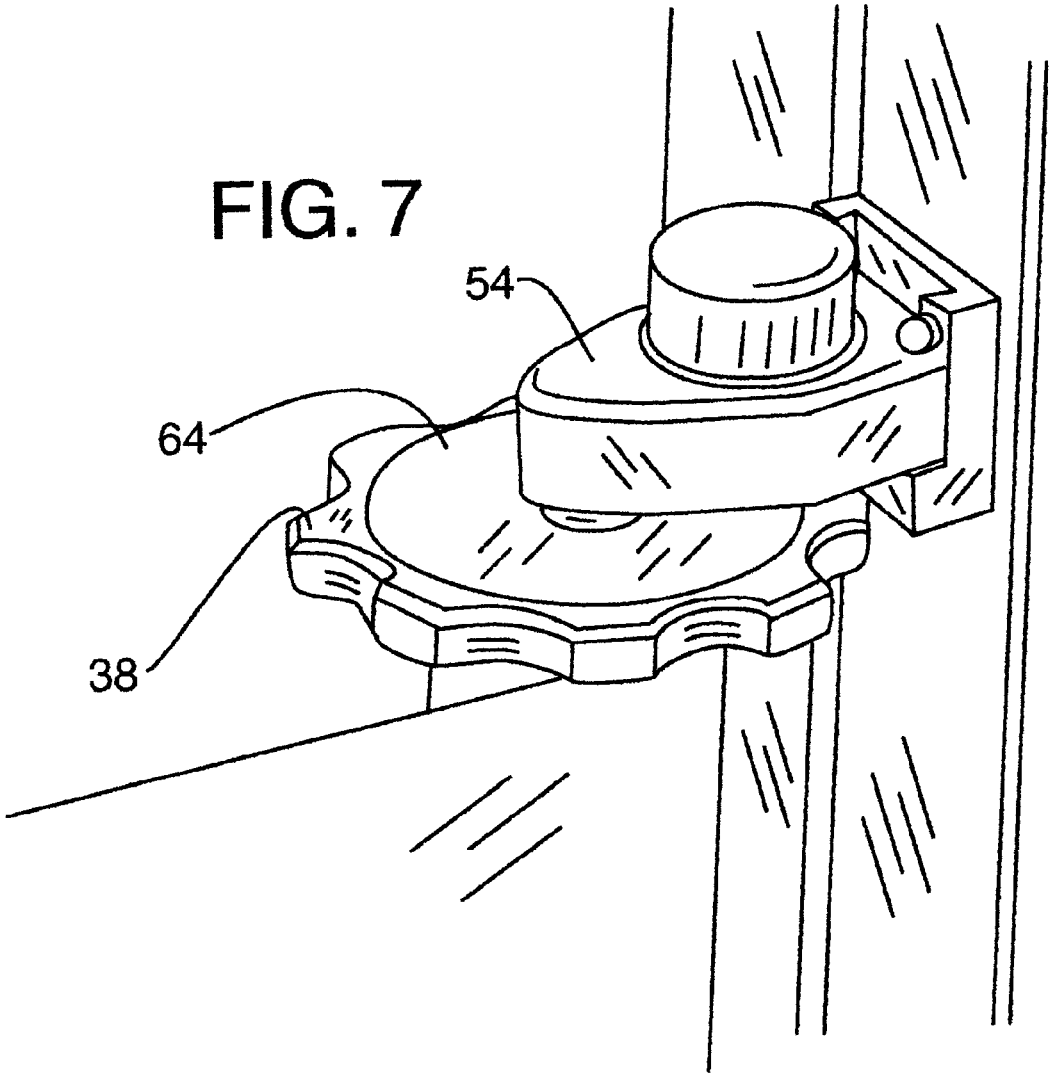
FIG. 7 is a perspective view showing a portion of the top end of the assembled roller, gear wheel, and clutch mechanism.
Figure 8:
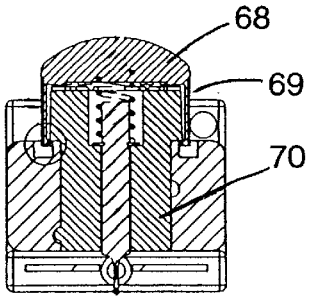
FIG. 8 is a sectional view showing the childproof release knob and clutch and clutch housing, and a ratchet pin of the ratcheting mechanism for the barrier storage roll.
Figure 9:
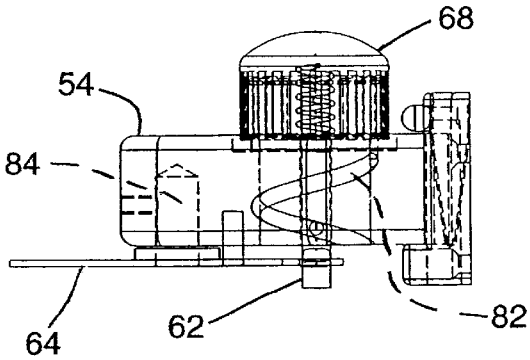
FIG. 9 is a side view of the apparatus shown in FIG. 8.

FIGS. 6–10, along with FIG. 5, show the structure and indicate the manner of operation of the ratchet assembly and of a release clutch having a childproof safety feature to prevent the child from releasing tension in the stretched and tensioned barrier sheet 14, i.e., a childproof tension release means. A release knob 68 is shown in FIG. 6, configured to fit down over a clutch spool 70 which itself is journalled for rotation within the clutch housing 54. FIGS. 8 and 9 show these components assembled. The inside of the childproof release knob 68 has teeth (not clearly shown in the drawings) which engage downwardly against upper teeth 72 on the spool 70, as shown in FIG. 6. Such a safety clutch means is well known in childproof devices, including pharmaceutical bottles and jars. Typically the teeth 72 have a ramp slope at one edge, and a steep abutment (e.g. 90°) at the opposite edge, so that the release knob 68 tends to slip when it is rotated in the releasing direction, unless it is pushed down with a fair amount of force to engage against the ramps and rotate the spool. In the apparatus shown in FIG. 6, this would be the counterclockwise direction. On other hand, when the knob 68 is turned in the opposite, clockwise direction, it easily engages the sharp abutments of the teeth 72 and rotates the spool with it in the clockwise direction. The knob or outer cap 68 is held to the spool 70 by a depending annular flange 69, the bottom edge of which snaps under a ledge 71 of the spool on assembly.

A compression spring 74 engages downwardly against a clip 76 which on assembly is fixed into a groove 78 on the pawl 62, thus urging the pawl 62 downwardly against the ratchet wheel 60, shown in FIG. 5. The top of the spring 74 engages against a closure disc 79 which is fixed to the top of the spool 70 or within the top of the center aperture 81 of the spool, closing that aperture.

Figure 10:
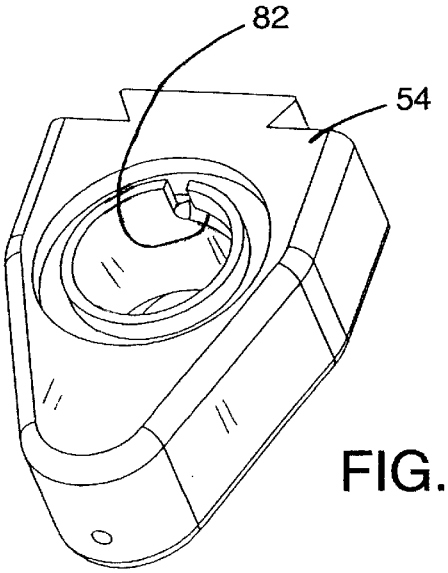
FIG. 10 is a perspective view showing the clutch housing which also acts as the upper mounting bracket positioned above the roller.

The spool 70 has a nub or boss 80 to engage with a coarse thread groove 82 which follows a helical path as shown in FIG. 9. When the spool is unscrewed, i.e. rotated in the counterclockwise direction, the nub 80 will follow the thread groove 82 to raise the spool upwardly within the clutch housing 54. This is effective to raise the lower end of the pawl 62, as can be seen from FIGS. 6, 8 and 9, thus removing the pawl from contact with the ratchet wheel 60 and releasing tension in the barrier sheet. The thread groove 82 of the clutch housing 54 is best seen in FIG. 10.

FIG. 9 also shows a bore 84 (dashed lines) in the clutch housing 54, to receive the upper end of the roller rod 52.

In use of the movable barrier 10, the brackets 44, 46, 28 and 30 are mounted within a throughway such as a doorway, hall, stair area, etc. Multiple sets of these four brackets are provided, so that the barrier assembly 10 can be used at several different locations within the living space, office, etc. The roller side 40 of the apparatus is assembled into the throughway by slipping the back edge of the clutch housing into the bracket 46 and the back end of the lower mount 56 into the bracket 44. Before assembling the device into the mounting brackets, the user should be sure that there is some degree of tension within the spring 50, so that the roller 16 tends to be pulling the sheet 14 toward retraction, even though it is fully retracted as in FIG. 3. This can be done by making several rotations of the bracket 46 in the winding-up direction (counterclockwise as seen in FIGS. 2 and 3), just before mounting the unit. The unit is now ready for operation.

Before the barrier 14 can be extended across the throughway, the childproof release knob 68 has to be rotated, to raise the clutch spool 70 (FIG. 6). This removes the ratchet pawl 62 from the ratchet wheel 60 and allows extending rotation of the roller, i.e. clockwise rotation as seen in the drawings.

When the user desires to extend the barrier to close a throughway, the handle 18 is gripped and used to pull the free end of the sheet of barrier material 14 to the left as seen in the drawings, until the opposite jamb or wall is encountered. The bottom of the rod 20 is manipulated into the recess of the lower mounting bracket 28, which is easily accomplished using the horizontally extending handle, facilitating manipulation of the rod 20. Once the rod is in place in the bracket 28, the upper end of this device is pushed between the flanges 32 of the mounting bracket 30 using the handle 18, until the spring pins 34 spring outwardly, popping into the flange holes 36.

Once the barrier is in place across the throughway, with the handle 18 latched, the childproof release clutch knob 68 is rotated back down, to the locked position. This prevents further extension of the barrier sheet.

Normally it is desired to fix a strong tension within the barrier sheet 14, to provide a relatively solid wall which is not yieldable to any appreciable extent. This is done by rotating the tensioning wheel 38 and thus, the roller in the tightening direction, counterclockwise in the drawings, to rotate the roller 16 in the retraction direction and increase tension. This causes a click-click-click of the ratchet assembly, as the pawl 62 ratchets against the ratchet wheel 60. Each notch of tensioning is retained by a tooth of the ratchet wheel, and the pawl is permitted to rise and fall with each tooth, against the pressure of the compression spring 74 (FIG. 6).

The child or dog will now encounter a nearly solid wall due to the tension of the barrier 14 across the throughway. Since the release knob 68 and clutch have the childproof feature, any child young enough and small enough to be contained behind the barrier will be unable to manipulate the knob to the release position.

When the barrier is to be retracted, one could simply pinch in on the pins 34 of the handle 18, thus releasing the device from the opposed end 42. The spring would retract the barrier sheet even though the ratchet pawl engages the ratchet wheel. However, with high tension in the barrier this can be difficult and anything but smooth. Thus, the user will preferably push down on the childproof release knob 68, rotate the knob in the counterclockwise direction and thus lift the spool 70 to release the pawl from the ratchet and thus to release the added tension in the barrier. This can be done while applying torque to the tensioning wheel 38, if desired. Once so released, the only tension in the barrier would be that afforded by the spring 50 within the roller. The spring pins 34 are then pinched so as to allow release of the handle 18, and the rod 20 is lifted out of the lower bracket 28, whereby the coil spring 50 will retract the barrier around the roller, back to the position shown in FIG. 3.

When the barrier is to be used at a different location, the user simply lifts the unit out of the roller-end mounting brackets 44 and 46, and installs the unit in similar mounting brackets mounted at a different throughway location.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. An infant barrier device for use in doorways, hallways, stair landings or other throughways to close off access essentially from a floor up to a desired level defined by the height of the barrier, comprising:

a sheet of flexible material of sufficient length to span across the throughway to be closed, a spring biased retraction roller on which the flexible material is mounted, with frame means retaining the roller for rotation at top and bottom at a roller side of the barrier device, a first jamb connector means for connection to a door jamb or wall or other generally vertical structure at one side of the throughway to be closed, quick release connection means secured to the frame means and operable for securing the frame means and the connected roller to the first jamb connector means when the infant barrier is needed in the throughway, a second jamb connector means for an opposite side of the throughway, with means for connection to a door jamb, wall or other structure, latch means operative between an extended end of the sheet of barrier material and the second jamb connector means, for securing the extended end to the second jamb connector means when the sheet of barrier material has been extended across the throughway as a barrier, barrier tensioning means, including a manual handle grippable by a user at an end of the roller, for tightening and tensioning the sheet of material by back-rotating the roller using the manual handle, and with ratchet means associated with the manual handle for latching increased tension in the sheet of material as the manual handle is rotated, and childproof tension release means connected to the ratchet means for releasing tension on the sheet of material so as to facilitate extension and retraction of the sheet of material when unlatched from said second jamb connection means.

2. The infant barrier device of claim 1, wherein the childproof tension release means includes a manual gripping knob with clutch means preventing release of tension unless a deliberate axial force is placed on the gripping knob, prior to turning of the gripping knob.

3. The infant barrier device of claim 2, wherein the childproof tension release means includes a rotatable spool member positioned for engagement with the gripping knob when the knob is pushed firmly downward and turned, and a clutch housing within which the spool is positioned, and including a screw thread between the spool and the clutch housing such that when the spool is rotated in a releasing direction, it rises up relative to the clutch housing, and including a pawl spring-loaded downwardly within an opening at the center of the spool, positioned to make spring-loaded engagement with the ratchet means, the ratchet means including a circular array of ratchet teeth fixed to and rotatable with said manual handle and positioned such that a lower end of the pawl engages in the ratchet teeth, the teeth being oriented so as to prevent rotation of the retraction roller in the direction of extension of the flexible material, except when the pawl is released from the ratchet teeth by rotation of the spool in said releasing direction.

4. The infant barrier device of claim 1, wherein the quick release connection means comprises dovetail connectors extending from the frame means, in the direction of the first jamb connector means, at top and bottom of the frame means and roller, and the first jamb connector means comprising upper and lower dovetail-shaped sockets spaced apart vertically and positioned so as to receive the dovetail connectors when the frame means is moved against the jamb connector means and lowered to engage the dovetail connectors in the sockets.

5. The infant barrier device of claim 1, wherein the latch means at the extended end of the sheet of barrier material comprises a substantially vertically oriented rod secured to the extended end of the sheet of material, said second jamb connector means including a bottom bracket having an upwardly oriented recess for receiving a bottom end of the rod, and an upper bracket positioned to latch with an upper end of the rod once the rod has been seated in the recess of the lower bracket.

6. The infant barrier device of claim 5, wherein the upper bracket forming a part of the latch means includes a pair of generally parallel flanges extending toward the roller side of the device and each having a hole, and the upper end of the rod including a pair of spring latch pins positioned to be forced inwardly when the upper end of the rod is pushed between the flanges and to spring outwardly to latch into said holes when aligned with the holes.

7. The infant barrier device of claim 5, wherein the rod at the extended end of the flexible material has a handle at its top end, extending generally perpendicularly from the vertical rod and toward the roller side of the device, for holding by a user in latching and unlatching the extended end of the barrier with the second jamb connector means.

8. The infant barrier device of claim 1, wherein the sheet of flexible material comprises vinyl-coated woven fibers.

9. The infant barrier device of claim 1, comprising a set of parts which includes additional first and second jamb connector means, such that the barrier device may be released from one location which is fitted with the first and second jamb connector means and moved to another location fitted with such jamb connector means, by use of the quick release connection means.

* * * * *